United States Patent [19]

Ooms et al.

[11] Patent Number: 4,728,847

[45] Date of Patent: Mar. 1, 1988

[54] ELECTRIC LAMP HAVING AN ENVELOPE WITH AN INTERMEDIATE ZIRCONIUM OXIDE COATED LAYER

[75] Inventors: Leo F. M. Ooms; Victor R. Notelteirs, both of Turnhout, Belgium

[73] Assignee: U.S. Philips Corporation, New York, N.Y.

[21] Appl. No.: 853,785

[22] Filed: Apr. 18, 1986

[30] Foreign Application Priority Data

May 17, 1985 [NL] Netherlands ..... 8501425

[51] Int. Cl.[4] ..... H01J 61/35; H01J 5/16; H01J 7/24

[52] U.S. Cl. ..... 313/43; 313/44; 313/635; 313/318

[58] Field of Search ..... 313/318, 623, 624, 113, 313/579, 634, 635, 43–47

[56] References Cited

U.S. PATENT DOCUMENTS

| | | | |
|---|---|---|---|
| 3,588,564 | 6/1971 | Vetere | 313/43 |
| 3,784,861 | 1/1974 | Notelteirs et al. | 313/117 |
| 4,342,937 | 8/1982 | Nagel | 313/113 |
| 4,464,603 | 8/1984 | McVey | 313/624 |
| 4,568,854 | 2/1986 | Westlund, Jr. et al. | 313/579 |

FOREIGN PATENT DOCUMENTS

| | | | |
|---|---|---|---|
| 2089563 | 6/1982 | United Kingdom | 313/318 |

*Primary Examiner*—David K. Moore
*Assistant Examiner*—Mark R. Powell

[57] ABSTRACT

An electric lamp having a glass lamp vessel 1 with a seal 7 coated with an intermediate coating layer of zirconium oxide 8. Lamp vessel 1 is connected at its seal 7 by a sealing cement 9 to a lamp cap 2. Zirconium oxide coating 8 completely separates seal 7 from sealing cement 9 and reduces mutual adherence therebetween. During operation of the lamp, zirconium oxide coating 8 reduces the thermal load and prevents cracking of seal 7 of lamp vessel 1.

18 Claims, 2 Drawing Figures

ELECTRIC LAMP HAVING AN ENVELOPE WITH AN INTERMEDIATE ZIRCONIUM OXIDE COATED LAYER

The invention relates to an electric lamp comprising a lamp vessel of glass having a silica content of at least 95% by weight. The lamp vessel is sealed in a vacuum-tight manner and has a seal through which at least one current supply conductor extends to a light source arranged inside the lamp vessel. The current supply conductor is connected to a contact on a lamp cap which is fixed with cement on the seal of the lamp vessel. Such a lamp is known from British patent specification No. 2,089,563.

Lamps of this kind may be subjected during operation to a high thermal load, especially when they are operated in a luminaire. The seal of the lamp vessel is liable to crack at the area at which it is secured in the lamp cap, which results in the lamp seal becoming defective.

The invention has for its object to provide an improved lamp in which the glass seal is prevented from cracking and the lamp seal is prevented from becoming defective.

According to the invention, this object is achieved in a lamp of the kind mentioned in the opening paragraph in that the seal of the lamp vessel has a coating comprising zirconium oxide at the area at which it is surrounded by the cement.

The coating of zirconium oxide causes the adherence of the cement to the seal to be reduced. Nevertheless, the lamp vessel is rigidly anchored in the lamp cap because the cement tightly surrounds the seal of the lamp vessel. In lamps according to the invention, cracks and leakage were no longer observed, probably due to the reduction of the adherence of cement to quartz glass.

The invention is applicable to lamps of different kinds and intended for different lamp applications. The light source may be a filament or a pair of electrodes in an ionizable gas filling. Furthermore, the light source may comprise an inner envelope arranged inside the lamp vessel.

The lamp vessel may have one seal through which current supply conductors of the lamp are passed, or it may have several seals, for example, two seals. At least one current supply conductor extends through each seal of the lamp vessel, and each seal is fixed by cement on a lamp cap. The lamp cap may mainly consist of ceramic material, of mainly metal or of a combination of ceramic material and metal.

The lamp may be used as a studio, theatre or projection lamp.

The coating of zirconium oxide is applied to the seal by immersing in, spraying or coating with, a suspension of zirconium oxide in, for example, butylacetate, or alternatively by applying zirconium oxide by flame spraying. The coating of zirconium oxide may contain, for example eight % by weight of a glass enamel, which itself consists, for example, of 37.7% by weight of $SiO_2$, 22.0% by weight of $B_2O_3$, 0.05% by weight of $Na_2O$, 3.8% by weight of CaO, 18.4% by weight of BaO, 17.8% by weight of $Al_2O_3$, 0.025% by weight of $Fe_2O_3$.

Embodiments of the lamp according to the invention will now be described, by way of example, with reference to the accompanying drawing. In the drawing.

Figure 1:
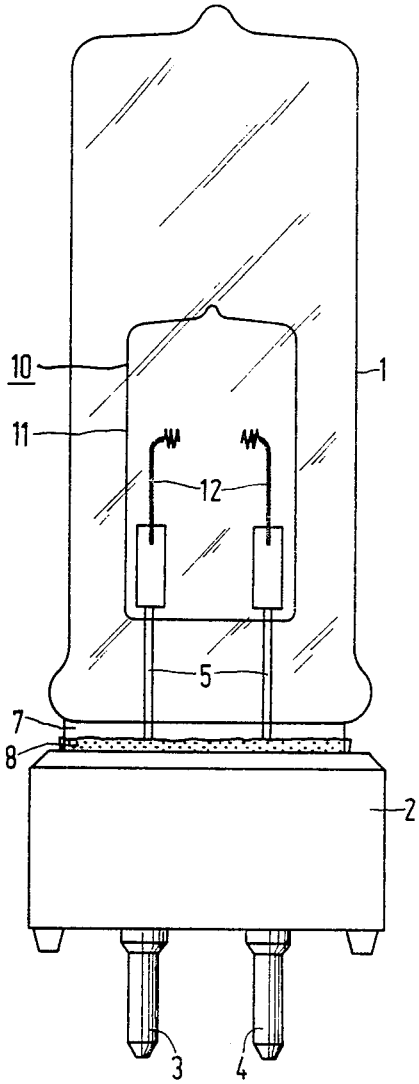
FIG. 1 shows a first embodiment of a lamp in side elevation.

The lamp shown in FIG. 1 has a quartz glass lamp vessel 1 sealed in a vacuum-tight manner and having a seal 7, through which current supply conductors 5 extend to a light source 10 arranged inside the lamp vessel 1. The light source 10 has a quartz glass inner envelope 11 in which a pair of electrodes 12 are arranged in an ionizable gas filling.

The seal 7 is fixed by cement in a lamp cap 2 which mainly consists of ceramic material and whose contacts 3,4 are connected to a respective current supply conductor 5. The cement is a mixture of powdered silica, sodium silicofluoride and sodium silicate. An alternative mixture of cement includes powdered talc, zinc oxide and potassium silicate.

The seal 7 is coated with zirconium oxide 8 at the area at which it is surrounded by the cement, so as to completely separate the seal from the cement.

Figure 2:
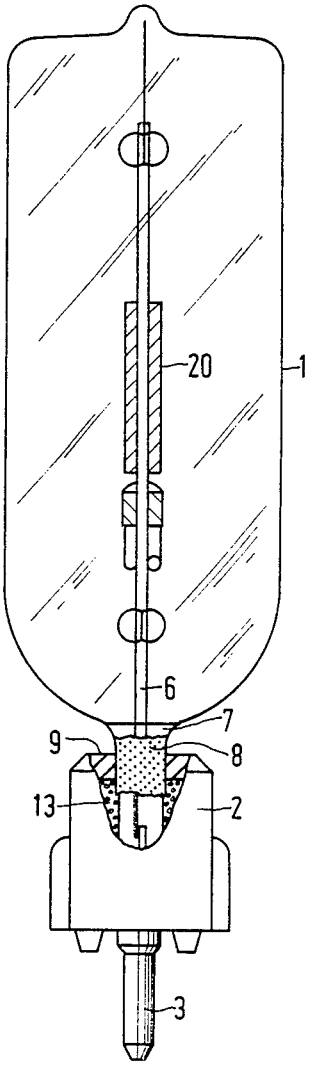
FIG. 2 shows a second embodiment of a lamp in side elevation with a lamp cap broken away.

FIG. 2 shows a lamp having a similar lamp vessel 1 and a similar lamp cap 2 as that shown in FIG. 1. A biplanar filament 20, arranged in a halogen-containing gas filling, constitutes a light source. Current supply conductors 6 extend through the seal 7 from the contacts 3 (contact 4 not shown compare FIG. 1) on the lamp cap 2 to the light source 20. The lamp cap 2 is filled for a considerable part with a granular material 13, such as sand or aluminium oxide, which is covered with cement 9. The cement 9 holds the seal 7 anchored in the lamp cap 2.

In experiments leading to the lamp according to the invention, besides the white $ZrO_2$ coating, various other coatings including black graphite, were tested. The black graphite was tested because it was believed to yield a good heat transfer from the seal to the lamp cap.

In comparison tests on 2000 W, 220 V film studio halogen incandescent lamps, a thermocouple was provided in the lamp cap in order to measure the temperature of the seal of the lamps. The results obtained are indicated in the Table below.

TABLE

| Lamp | Temperature | Adherence cement | Anchoring |
|---|---|---|---|
| without coating | 375° C. | yes | good |
| $ZrO_2$ coating | 357° C. | no | good |
| graphite coating | 388° C. | no | moderate |

These results show the graphite coating does not lead to reduction of the temperature of the seal, but on the contrary leads to an increase thereof of 13° C. Furthermore, and unexpectedly, the zirconium oxide coating causes this temperature to be reduced by 18° C. so that the thermal load of the seal is lower than without a coating. Moreover, the lamp coated with zirconium oxide is anchored more satisfactorily than the lamp coated with graphite.

What is claimed is:

1. An electric lamp comprising a lamp vessel of glass having a silica content of at least 95% by weight, which is sealed in a vacuum-tight manner and has a sealed end portion through which a current supply conductor extends to a lighting source arranged inside the lamp vessel, said current supply conductor being connected to a contact on a lamp cap fixed by a cementing substance disposed around a given area of the sealed end portion of the lamp vessel, characterized by comprising means for reducing adhesion of the cementing substance to said glass while substantially maintaining anchoring of the end portion in the lamp cap, said means comprising an intermediate coating applied to said glass at said area at which it is surrounded by the cementing substance.

2. An electric lamp as claimed in claim 1, wherein said intermediate coating comprises zirconium oxide.

3. An electric lamp as claimed in claim 1, characterized in that the intermediate coating comprises a glass enamel in addition to zirconium oxide.

4. An electric lamp comprising:

a lighting source;

a lamp vessel of glass having a silica content of at least 95% by weight, having said lighting source arranged therein and being sealed in a vacuum-tight manner, said lamp vessel having at least one sealed end portion;

a plurality of current supply conductors, each of said current supply conductors extending through one of said at least one sealed end portion and electrically connected to said lighting source;

at least one lamp cap having at least one electrical contact, each of said current supply conductors being connected to a respective one of said at least one contact of said at least one lamp cap, each of said at least one sealed end portion of said lamp vessel being disposed in a respective one of said at least one lamp cap, and a cementing substance disposed around a given area of said at least one sealed end portion, and securing each of said at least one sealed end portion of said lamp vessel in a respective one of said at least one lamp cap; and an intermediate coating layer applied to said glass of said at least one sealed end portion at said given area at which it is surrounded by said cementing substance, said coating layer completely separating said at least one sealed end portion from said cementing substance, said coating layer causing a reduced adherence between said cementing substance and said given area of said at least one sealed end portion, which is less than an adherence between said cementing substance and said given area of said at least one sealed portion in the absence of said intermediate coating layer.

5. An electric lamp as claimed in claim 4, wherein said coating means comprises zirconium oxide.

6. An electric lamp as claimed in claim 4, wherein said zirconium oxide comprises 8% by weight of a glass enamel.

7. An electric lamp as claimed in claim 6, wherein said glass enamel comprises 37.7% by weight of $SiO_2$, 22.0% by weight of $B_2O_3$, 0.05% by weight of $Na_2O$, 3.8% by weight of CaO, 18.4% by weight of BaO, 17.8% by weight of $Al_2O_3$, and 0.025% by weight of $Fe_2O_3$.

8. An electric lamp as claimed in claim 4, wherein said lighting source comprises a filament.

9. An electric lamp as claimed in claim 4, wherein said lighting source comprises a pair of electrodes in an ionizable gas filling.

10. An electric lamp as claimed in claim 4, wherein said light source comprises an inner envelope arranged inside said lamp vessel having another light source arranged inside.

11. An electric lamp as claimed in claim 4, wherein said at least one lamp cap is comprised substantially of ceramic.

12. An electric lamp comprising:

a lighting source;

a lamp vessel of glass having a silica content of at least 95% by weight, having said lighting source arranged therein and being sealed in a vacuum-tight manner, said lamp vessel having a sealed end portion;

a plurality of current supply conductors, each of said current supply conductors extending through said sealed end portion and electrically connected to said lighting source;

a lamp cap having a plurality of electrical contacts, each of said current supply conductors being connected to a respective one of said contacts of said lamp cap, said sealed end portion being disposed in said lamp cap, and a cementing substance disposed around a given area of said sealed end portion, and tightly surrounding and rigidly anchoring said sealed end portion in said lamp cap; and an intermediate coating layer comprising zirconium oxide applied to said glass of said sealed end portion at said area at which it is surrounded by said cementing substance, said zirconium oxide completely separating said sealed end portion from said cementing substance, said zirconium oxide causing a reduced adherence between said cementing substance and said given area of said sealed end portion, which is less than an adherence between said cementing substance and said given area of said sealed portion in the absence of said zirconium oxide.

13. An electric lamp as claimed in claim 12, wherein said zirconium oxide comprises 8% by weight of a glass enamel.

14. An electric lamp as claimed in claim 13, wherein said glass enamel comprises 37.7% by weight of $SiO_2$, 22.0% by weight of $B_2O_3$, 0.05% by weight of $Na_2O$, 3.8% by weight of CaO, 18.4% by weight of BaO, 17.8% by weight of $Al_2O_3$, and 0.025% by weight of $Fe_2O_3$.

15. An electric lamp as claimed in claim 12, wherein said lighting source comprises a filament.

16. An electric lamp as claimed in claim 12, wherein said lighting source comprises a pair of electrodes in an ionizable gas filling.

17. An electric lamp as claimed in claim 12, wherein said light source comprises an inner envelope arranged inside said lamp vessel having another light source arranged inside.

18. An electric lamp as claimed in claim 12, wherein said lamp cap is comprised substantially of ceramic.

* * * * *